United States Patent [19]

Singer et al.

[11] 3,958,061

[45] May 18, 1976

[54] COMPOSITION FOR MAKING TEXTILES FLAME-PROOF AND ITS APPLICATION

[75] Inventors: Heinrich Singer, Horgau; Sandor Csajági, Augsburg, both of Germany

[73] Assignee: Ciba-Geigy Corporation, Ardsley, N.Y.

[22] Filed: May 16, 1973

[21] Appl. No.: 360,872

[30] Foreign Application Priority Data

May 27, 1972 Germany ..... 2225934

[52] U.S. Cl. ..... 428/276; 8/116 P; 106/15 FP; 252/8.1; 427/421; 427/434; 428/921

[51] Int. Cl.[2] ..... C09K 3/28

[58] Field of Search ..... 252/8.1; 8/116 P; 106/15 FP; 117/136, 137; 161/403; 427/421, 434; 428/276, 921

[56] References Cited

UNITED STATES PATENTS

| | | | |
|---|---|---|---|
| 3,321,555 | 5/1967 | Lutz et al. | 252/8.1 X |
| 3,761,543 | 9/1973 | Cunsher | 252/8.1 X |
| 3,835,194 | 9/1974 | Leavitt | 252/8.1 X |

*Primary Examiner*—Leland A. Sebastian
*Attorney, Agent, or Firm*—Joseph G. Kolodny; Edward McC. Roberts; Prabodh I. Almaula

[57] ABSTRACT

The present invention is concerned with the flame-proof finishing of textiles, and provide, a flame-proofing composition capable of giving stable emulsions in organic water-insoluble solvents. The composition comprises a salt of (a) guandine or salts thereof with weak acids, dicyandiamide or cyanamide and/or reaction products thereof with formaldehyde, and (b) acid mono and/or diphospheric acid esters of alcohols having 1 to 4 carbon atoms, the salt of (a) and (b) having in aqueous solution a pH value of more than 3.6, and (c) 3 to 15% by weight, based on the weight of the solid content of the composition, of compounds having the general formulae:

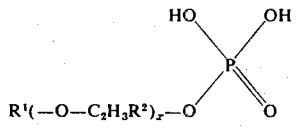

(I)

and/or

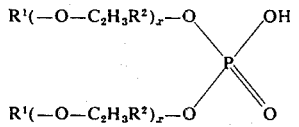

(II)

$x$ being equal to 2 to 15, $R^1$ representing a saturated alkyl group having 4 to 18 carbon atoms, and $R^2$ representing hydrogen or a methyl group. An advantage of the composition is that it can be applied from organic water-insoluble solvents.

17 Claims, No Drawings

COMPOSITION FOR MAKING TEXTILES FLAME-PROOF AND ITS APPLICATION

The invention relates to a composition for making textiles flame-proof and its application.

Non-permanent flame-proof finishing by means of salt-like compounds has long been known. There are employed inter alia various phosphates, such as, for example guanidine phosphate and ammonium phosphates. These products can, however, only be applied from aqueous medium.

The most modern development is increasingly directed towards subjecting the textiles, and above all made-up textiles, to a chemical cleaning, instead of the normal washing. It has not hitherto been found possible to develop a flame-proofing agent which exhibits a good flame-proofing action and which can be applied from organic, water-insoluble solvents. The known products can be emulsified in the solvent, but they precipitate after a short time, so that application of these products in the solvent is not very practical.

An object of the invention is to provide a medium for rendering textiles flame-proof which can be used in the form of a stable emulsion in an organic water-insoluble solvent.

A composition has been found, which gives stable emulsions in organic water-insoluble solvents and which is suitable in this form for flame-proofing textiles. Furthermore, the composition substantially avoids the above-mentioned disadvantages, the composition comprising salts of (a) guanidine or salts thereof with weak acids, dicyandiamide or cyanamide and/or reaction products thereof with formaldehyde, and (b) acid mono- and/or di-phosphoric acid esters of alcohols having 1 to 4 carbon atoms, the salts of (a) and (b) having in aqueous solution a pH value of more than 3.6, and (c) 3 to 15% by weight, based on the weight of the solid content of the composition of compounds having the general formulae,

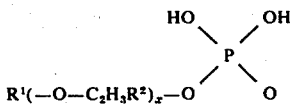

(I)

and/or

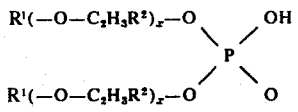

(II)

in which $x = 2$ to 15, $R^1$ represents a saturated alkyl group having 4 to 18 carbon atoms, and $R^2$ represents hydrogen or a methyl group.

Preferably the compounds of formulae I and/or II are present in the form of their alkali, ammonium or amine salts, more especially in the form of neutralisation products with the non-methylolated compounds (a).

The composition of the invention impart a soft and full handle to the finished textiles. The flame-proofing effects, determined in accordance with DIN 53 906, are excellent, that is to say, an unmeasurable burning duration and after-glow period is obtained throughout. A particular advantage of the medium is that when they are used, no corrosion occurs in the finishing machines.

There are employed as compounds (a) for the preparation of the medium according to the invention guanidine or its salts with weak acids whose dissociation constant is lower than that of compounds I and/or II, such as guanidine carbonate or guanidine acetate, and dicyandiamide or cyanamide and/or reaction products thereof with formaldehyde. These compounds are generally employed in technical quality. Naturally, mixtures of these products may also be used. The guanidine salts, more especially guanidine carbonate, are preferably employed. The methylol compounds are prepared in known manner by reacting the aforesaid compounds with formaldehyde in the form of the aqueous solutions or of paraformaldehyde, from 0.2 to 0.7 and more especially from 0.2 to 0.5 moles of formaldehyde being employed per mole of starting compound.

As compounds (b), acid mono- and/or diphosphoric acid esters of alcohols having 1 to 4 carbon atoms are used, mixtures of mono- and di-phosphoric acid esters preferably being employed. It is particularly advantageous to employ the mixtures of the mono- and diphosphoric acid esters of methanol and ethanol. The aforesaid acid esters or ester mixtures are prepared in known manner by reaction of phosphoric acid with the corresponding quantity of alcohol. Naturally, it is also possible for phosphorus pentoxide and the desired alcohol to be reacted with one another in known manner in a molar ratio of 1:2 to 1:4.

As emulsifiers for the salts prepared by neutralisation of the compounds (a) with the compounds (b), there are employed in the medium according to the invention the compounds (c) having the general formulae I and/or II, in which $x = 2$ to 15, preferably 2 to 10, $R^1$ represents a saturated alkyl group with 4 to 18 and more particularly 4 to 9 carbon atoms, $R^2$ represents a hydrogen atom or a methyl group. Examples of compounds having the general formulae I and/or II, are the following:

The mono- and/or di-phosphoric acid esters of dodecyltriethylene-glycol ether, of octyl pentaethylene-glycol ether, of butyl heptaethylene-glycol ether, of decyl tetraethylene-glycol ether, of hexyl decaethylene-glycol ether and of stearyl pentaethylene-glycol ether, it being readily possible to replace the ethylene oxide by propylene oxide.

The use of these phosphoric acid esters, however, has the disadvantage that the flame-proofing medium obtained becomes relatively highly acidic, so that damage to fibres cannot be entirely eliminated and corrosion may occur in the machines used for the finishing.

Therefore, it is preferable to use as compounds (c) the reaction products of the compounds of formulae I and/or II with the non-methylolated compounds (a) or with known bases. In the reaction, the pH value is preferably adjusted to more tnan 3.6, and more especially to 5.0 to 7.0. As bases there may be used inter alia alkali hydroxides and carbonates, as well as amines, more particularly lower amines, such as propylamine or lower alkanolamines, such as mono-ethanolamine or triethanolamine.

Regardless of whether the compounds of formulae I and/or II, or the products of reaction thereof with the non-methylolated compounds (a) or bases are employed as emulsifiers, they are used in a quantity of 3 to 15% by weight, more particularly 8 to 12% by weight, based on the weight of the whole mixture.

The medium according to the invention may be obtained as follows:

In a first stage, the compound (a) is prepared with stirring under reflux and cooling, and a small quantity of water is added, so that a substantially 40 to 80% paste is formed. The compound (b) is then slowly added to this mixture with stirring. As a result of the slightly exothermic reaction, the temperature rises slightly. Finally, the mixture is slowly heated to about 45° to 80°C and is slowly stirred at this temperature for 0.5 to 1.5 hours. A clear solution is obtained which is concentrated preferably in vacuo to about 50 to 75% solid content. The pH value of the finished product should be above 3.6 and preferably above 5.

The salt-like product thus prepared may be directly mixed with 3 to 15% by weight of compounds (c) of the formulae I and/or II, whereby the medium according to the invention is formed.

Preferably, however, the acid esters are not directly added, but the at least partially neutralized products of compounds I and/or II are first prepared. In order to prepare these, the following procedure is adopted.

The compounds of formulae I and/or II are again diluted with water, so that a 30 to 60% solution is formed, which is slowly adjusted to a pH value of more than 3.6 and preferably 5 to 7, by the addition of the non-methylolated compounds (a) or of the aforesaid bases. Naturally, the aforesaid compounds (a) or the base may also be diluted with water and adjusted to the desired pH value with the compounds I and/or II. Thereafter, the mixture obtained is further stirred for some time, more particularly for 45 to 90 minutes, at 50° to 75°C. Finally, the product is concentrated more particularly in vacuo, to 50 to 75% as in the first stage.

Both the salt-like compounds prepared in the first stage and the compounds (c) of formulae I and/or II, or their alkali, ammonium or amine salts, or products of reaction with the non-methylolated compounds (a) may be prepared in more highly concentrated form. However, these products are less suitable in practice owing to the fact that they are difficult to handle.

After completion of the reaction, and in order to obtain the medium according to the invention, there is again added to the product obtained in the first stage a quantity of the product (c) which is such that the end product contains 3 to 15% by weight thereof.

In a particular development, in the preparation of the medium according to the invention, either a relatively large quantity of the compounds (a) is prepared at the start and thereafter successively reacted with the compounds (b) and the compounds of the formulae I and/or II to a pH value of more than 3.6 preferably more than 5, or conversely the compounds (b) and the compounds of the formulae I and/or II are prepared and thereafter adjusted with the compounds (a) to a pH value of more than 3.6 and preferably more than 5. In this so-called one-course process, however, it must be ensured that the compounds of formulae I and/or II are employed only in such quantities that, after completion of the reaction, i.e., after the pH value has been adjusted to the desired level, the proportion of reaction product from the compound (a) and the compounds of formulae I and/or II in the flame-proofing medium obtained is 3 to 15% and preferably 8 to 12%.

In accordance with the invention, the medium is preferably prepared in the one course process, i.e., either a relatively large quantity of the compound (a) is prepared at the start and successively neutralised with compounds (b) and compounds of the general formulae I and/or II, or conversely the acid esters are prepared and neutralised with the compounds (a). In any case, it must then be ensured that the substance prepared is again diluted with water, so that a easily-stirrable mixture is formed, and then adjusted to a pH value of 3.6 to about 7, and more particularly 5 to 7, by the addition of the compound (a) or of the acid esters. It may be desirable to add further water during the reaction if the mixture becomes too thick. It must be ensured in the reaction that the compounds of formulae I and/or II are employed only in such quantities that, after completion of the reaction, the reaction product from the compound (a) (other bases are not employed here) and the compounds of formulae I and/or II, is present in a quantity by weight of 3 to 15 % by weight, based on the weight of the whole mixture. Finally, the temperature is again maintained at about 50° to 80°C preferably for a further 45 to about 90 minutes, whereafter the product is concentrated, preferably in vacuo, to a solid content of 50 to 80% and more especially 60 to 70% by weight. In this way, the flame-proofing medium according to the invention is immediately and readily obtained.

The salts prepared as described above from the non-methylolated compounds (a) and the compounds (b) tend to crystallize, particularly at relatively low temperatures. This solid product formation is undesirable, because the product is difficult to emulsify and a level flame-proofing effect cannot be obtained in the flame-proofing finishing.

Particularly satisfactory results are obtained when the salts from the non-methylolated compounds (a) and the compounds (b) are present in partially methylolated form, in which case the methylolation may take place only after the addition of the compounds (c), or after the whole reaction in the case of the one course process.

Therefore, it is advantageous, after the reaction of the aforesaid compounds, and before or after the admixture of the compound (c), or after the whole reaction in the case of the one course process, if non-methylolated compounds (a) have been used as starting materials, to carry out a further reaction with formaldehyde, such as aqueous formaldehyde solutions, more particularly paraformaldehyde. In order that the handle of the goods to be finished may not be influenced, minimum possible quantities of formaldehyde are added, namely 0.2 to 0.7 and more particularly 0.2 to 0.5 mole of formaldehyde per mole of starting compound (guanidine or guanidine salts, dicyandiamide or cyanamide).

In this case, the methylolation is carried out by adding to the mixture obtained the desired quantity of form-aldehyde, more especially paraformaldehyde, and maintaining the mixture at 40° to 70°C for about one more hour with light stirring. As is the case when the methylolated compounds (a) are used as starting materials at the start, there are thereby obtained products which are liquid even at low temperature and thus allow a ready emulsification and a uniform finish.

As already stated there may also be employed as compounds (a) the products obtained by methylolation of guanidine or its salts with weak acids, dicyandiamide or cyanamide. This procedure has the advantage as compared with subsequent methylolation, that the reaction takes place with greater precision and also somewhat more rapidly.

These agents may be stirred directly into organic water-insoluble solvents, whereby stable emulsions are formed, which can then be employed for the flame-proofing of textiles. As organic, water-insoluble solvents the inert diluents commonly used in chemical cleaning, such as chlorinated hydrocarbons or chlorinated fluorohydrocarbons may be used, as well as aliphatic hydrocarbons. Tetrachloroethylene, trichloroethylene and 1,2,2-trifluorotrichloroethane have proved particularly suitable.

The finishing is carried out in known manner. The following possible methods of application may be particularly mentioned: In the normal chemical cleaning machine, the goods are tumbled for 5 to 20 minutes, and more particularly 8 to 15 minutes, after chemical cleaning with a liquor ratio of 1:6 to 1:20 (weight of the air-dry goods to volume), the liquor containing such a quantity of the medium according to the invention that, after complete finishing, 7 to 20%, and more particularly 9 to 15% by weight, calculated on the air-dry goods, have been absorbed, whereafter the goods are spun for a brief period and dried in the conventional manner at 60° to 80°C With this procedure, more than 90% of the flame-proofing medium according to the invention is absorbed by the goods.

As well as the above-described dipping and spinning methods, it is also possible to carry out the flame-proofing finishing with a spraying method. In this case, the spin-moist goods coming from the chemical cleaning are sprayed with the treatment solution (weight-/volume ratio of the solution 1:3), in a machine comprising a spraying device, are briefly tumbled, spun again and dried in the conventional manner. The sprayed-on liquor contains such a quantity of the flame-proofing medium according to the invention that again 7 to 20% thereof, calculated on the air-dry goods, are applied to the textile material.

Using the procedure described, all textiles, and more particularly made-up textiles consisting of natural and regenerated cellulose fibres, as well as wool, can be given a flame-proof finish. In addition, mixtures of these materials with synthetic fibres, such as polyesters, polyamides or polyacrylonitriles, in which the proportion of synthetic fibres is less than 50%, can be given a flame-proof finish in this way.

The flame-proof finish may be combined with an oilrepellent finish if the aqueous emulsions or organic solutions of the known oil-repelling agents, for example those based upon perfluoroalkanesulphonamide acrylates and their polymers and copolymers with fluorine-free monomers, are added in conventional concentration to the treatment liquors. It is surprising that oil-repelling agents can be added without impairing the stability of the liquors. The combination does not affect the flame resistance. In addition to a good oil-repelling effect, a good water-repelling effect is obtained. Moreover, the material is at the same time rendered resistant to acids by this treatment.

In order to obtain in the flame-proof finish a handle which is particularly kind, soft and smooth to mentioned skin, it is desirable to add to the organic liquors 2 to 10% of softeners, based on the flame-proofing agent. As softeners, there may be mentioned by way of example optionally substituted fatty acid imidazolines, fatty acid amides or fatty acid alkylolamides neutralised with acid mono- and/or dialkyl phosphates (alkyl residue 1 to 6 carbon atoms), which are optionally alkoxylated, and other conventional cationic softeners.

Typical examples are: products of the reaction of oleic acid and aminoethyl ethanolamine or diethylenetriamine neutralised with dibutyl phosphate, or a mixture of mono- and di-phosphoric acid esters of ethoxylated 2-ethylhexanol (5 ethyoxy groups per alcohol on average), stearic acid methylol amide or di-$C_{12-18}$ alkyldimethylammonium chloride.

The invention will now be illustrated with reference to the following Examples.

EXAMPLE 1 a. In a 2-liter, three-necked, round-bottomed flask provided with a thermometer, a reflux condenser and a stirrer were prepared 180 g (about 1 mole) of guanidine carbonate, and 200 ml of water were added. Into the mixture obtained, were slowly stirred 202 g (about 1.8 mole) of monomethyl phosphoric acid ester. If the mixture was difficult to stir, it could be further diluted with up to 200 ml of water. With a strong evolution of $CO_2$, the temperature rose to about 30°C. When the evolution of gas had finished, the mixture obtained was heated on the water bath to about 60°C and stirred for 1 hour at this temperature. Thereafter, the clear solution was concentrated to 66 to 70% under a pressure of about 15 mm. The pH value of this solution was about 5.6.

b.1. In the above-described apparatus, 260 g of a technical mixture of mono- and diphosphoric acid ester of ethoxylated nonyl alcohol (on average 5 ethoxy groups per alcohol) were prepared, diluted with 400 ml of water and adjusted to a pH value of 5.7 with guanidine carbonate, a strong evolution of $CO_2$ again being observed. This mixture was also subsequently heated with slow stirring to 60°C and maintained at this temperature for 1 hour. The solution was finally concentrated to 66 to 70% at about 15 mm Hg.

b.2. In the same apparatus, 260 g of the mono- and diphosphoric acid esters mentiond in (b.1) were again prepared and diluted with water, and thereafter adjusted to the aforesaid pH value by means of potassium hydroxide solution. Using this procedure, the after-heating could be omitted and the product immediately concentrated in vacuo to the aforesaid concentration.

b3. As emulsifier, the technical mixture of mono- and diphosphoric acid esters of ethoxylated nonyl alcohol with an average of 5 ethoxy groups per alcohol could be employed.

For the preparation of the medium according to the invention, 12% of the products (b.1), (b.2) and (b.3) were added in each instance to the product (a), whereafter the mixture was thoroughly stirred.

EXAMPLE 2

In a 4-liter, three-necked, round-bottomed flask provided with a thermometer, a reflux condenser and a stirrer as indicated in Example 1, 360 g of guanidine carbonate, diluted with 400 ml of water, were prepared, and there were slowly added to this mixture 336 g (3 mole) of monomethyl phosphoric acid ester, which had previously been diluted with water in a proportion of 1:1. With a strong evolution of $CO_2$, the temperature rose to about 30°C. Immediately after the addition of the monomethyl phosphoric acid ester, there were added to the mixture obtained 52 g of the mono- and dinonyl phosphoric acid esters defined in (b.1) in Example 1, whereby the pH value fell from 11 to 5.3. During the addition of the said phosphoric acid esters, the mixture was diluted by the addition of a total of 400 ml of water in order to facilitate the escape of the $CO_2$ formed. Finally, the whole mixture was slowly heated to 60°C and maintained at this temperature for 1 hour and then concentrated in a water-jet vacuum to a solid content of 65 to 70%.

The medium thus produced could be stirred into tetrachloroethylene either directly or after 1:1 dilution with water, in the same way as the medium according to the invention obtained in Example 1, whereby a stable emulsion was obtained.

EXAMPLE 3

Into a 2-liter, three-necked, round bottomed flask were introduced, 120 g of a mixture of 50% monobutyl phosphoric acid ester and 50% of dibutyl phosphoric acid ester, as well as 10 g of a technical mixture of mono- and diphosphoric acid esters of propoxylated $C_{10}$–$C_{12}$ fatty alcohol (on average, 4 propoxy groups per alcohol), dissolved in 150 g of water, and cyanamide was slowly added thereto with stirring and moderate external cooling until the pH value of the mixture reached a value of 6.2. Thereafter, the product obtained was maintained at 55°C for 30 minutes on the water bath with stirring. There were stirred into the mixture obtained 8 g of paraformaldehyde, and the product was stirred for an additional 60 minutes at the aforesaid temperature.

The medium according to the invention thus prepared could readily be stirred into chlorinated hydrocarbons. The emulsion obtained was stable for a relatively long period of time.

EXAMPLE 4 a. Into the apparatus referred to in Example 1 was introduced 168 g (2 mole) of dicyandiamide, 300 ml of water were added and the mixture obtained was adjusted to a pH value of 5.5 with a technical mixture of 40 to 45% of mono- and 35 to 55% of diethylphosphoric acid ester (free phosphoric acid about 3%), with stirring. The mixture rose in temperature to about 40°C. The temperature was then raised to 65°C on the water bath and the product was slowly stirred for 70 minutes at this temperature. A paste was obtained which, for the purpose of liquefaction, was mixed with 30 g of formaldehyde in the form of a 37% aqueous solution, and again stirred for 1 hour at the aforesaid temperature. Finally, the product was concentrated to about 70% under normal pressure.

This product was obtained in a relatively short time if the dicyandiamide was first reacted with the aqueous formaldehyde solution at the aforesaid temperature, since it then took only half an hour for the further reaction with the said phosphoric acid ester to commence.

b. In the same apparatus, 100 g of a mixture of mono- and diphosphoric acid esters of ethoxylated decanol-(1) (on average 5 ethoxy groups per alcohol; molar ratio of monoester to diester about 1:1) were dissolved in 200 ml of water and adjusted to a pH value of 5.9 with guanidine. The mixture obtained was thereafter heated with stirring to 50°C, maintained at this temperature for 40 minutes and finally concentrated to about 60% under about 30 mm.

For the preparation of the medium according to the invention 9% of product (b) were added to the product (a) and the mixture finally thoroughly stirred. The agent thus prepared could be directly stirred into tetrachloroethylene, whereby there were obtained stable emulsions which could be used for flame-proof finishing.

An equally good medium was obtained if, in the preparation of product (b) instead of the phosphoric acid ester mixture mentioned therein, 110 g of a technical diphosphoric acid ester of octylpentaethylene-glycol ether was used.

EXAMPLE 5

Into a 4-liter, three necked, round-bottomed flask were introduced, 300 g of monoethyl phosphoric acid ester and 30 g of a mixture of mono- and di-phosphoric acid esters of ethoxylated hexanol-(1) (on average 12 ethoxy groups per alcohol). The mixture was diluted with 100 ml of water and adjusted to a pH value of 5.2 with about 180 g of guanidine carbonate, a strong evolution of $CO_2$ being observed with a moderate increase in temperature. The temperature was then raised to 70°C on the water bath and maintained at this level for 1 hour with stirring. Thereafter, the product was concentrated to 58% in vacuo.

The medium according to the invention thus obtained could be directly introduced into halogenated hydrocarbon, to produce stable emulsions very suitable for flame-proof finishing of cellulose-containing fabrics.

EXAMPLE 6

For the flame-proof finishing, 80 liters of a tetrachloroethylene liquor containing 1 kg of the medium prepared as described in Example 2 were applied, in a cleaning machine having a nominal load of 12 kg, to a total of 8 kg of domestic textiles consisting of wool cotton and wool-polyester (80:20) blended articles, which had undergone chemical cleaning and which were in a moist condition owing to their having been spin-dried. The goods were tumbled for 10 minutes, then briefly spun and dried for 15 minutes at 80°C. The flame-proofing agent was absorbed to an extent of 96% in the finishing.

The textiles thus finished exhibited excellent flame resistance. The test according to DIN 53 906 showed a value of 0 second both for the burning time and for the after-glow time.

EXAMPLE 7

A cleaning machine provided with a spraying device and having a rated load of 12 kg was charged with 9 kg of work jackets consisting of cotton twill (weight about 200 g per square meter) which were chemically cleaned in known manner. After removing cleaning solution from the articles, 27 liters of a 1,2,2-trifluoro-1,1,2-trichloroethane liquor which contained 1.2 kg of the medium prepared in accordance with Example 5 and 0.94 kg of a conventional oil-proofing agent (aqueous emulsion containing about 25% of solid substance) were sprayed onto them and they were then tumbled for 10 minutes whereby about 92% of the treatment agents were absorbed by the fibres. The articles were then spun for a brief period and dried for about 12 minutes at 70°C.

The work jackets, which had a soft, smooth handle, exhibited excellent flame-proofing effects (an after-burning time and an after-glow time of 0 second measured in accordance with DIN 53 906), and at the same time had an acid-proof finish. Moreover, they exhibited good oil-repelling and water-repelling effects.

EXAMPLE 8

On repeating Example 6 and adding to the organic liquor 75g of oleic acid imidazoline alkylphosphate prepared by neutralisation with dimethylphosphate of the oleic acid imidazoline prepared in accordance with U.S. Pat. No. 2,267,965 from oleic acid and aminoethyl ethanolamine there were obtained, with no other modification of the procedure, textiles which exhibited an equally good flame-proofing effect, but an appreciably softer and more pleasant handle.

We claim:

1. A composition which is capable of forming a stable emulsion in an organic water-insoluble solvent and which is suitable for flame-proofing textiles, which composition in aqueous solution has a pH-value greater than 3.6, and wherein the composition comprises a salt of (a) guanidine or its salts with weak acids, dicyandiamide, cyanamide, a condensate of guanidine and formaldehyde, a condensate of dicyandiamide and formaldehyde, or a condensate of cyanamide and formaldehyde, (b) a phosphoric acid mono- or di-ester of an alcohol of 1 to 4 carbon atoms, and (c) 3 to 15% by weight, based on the solid content of the composition, of a phosphoric acid mono- or di-ester of an alcohol of the formula $R^1(—O—C_2H_3R^2)_xOH$, wherein $x$ is 2 to 14, $R^1$ is a saturated alkyl group of 4 to 18 carbon atoms, and $R^2$ is hydrogen or methyl, or an alkali metal, ammonium or amine salt thereof.

2. The composition of claim 1, wherein component (c) is an alkali metal, ammonium or amine salt.

3. The composition of claim 2, wherein component (c) is a salt of guanidine, dicyandiamide or cyanamide.

4. The composition of claim 1, wherein the pH-value is greater than 5.0.

5. The composition of claim 1, wherein component (a) is a weak acid salt of guanidine.

6. The composition of claim 1, wherein $x$ is 2 to 10 and the number of carbon atoms in $R^1$ is 4 to 9.

7. The composition of claim 1, wherein component (a) is a guanidine-formaldehyde condensate, dicyandiamide-formaldehyde condensate or cyanamide-formaldehyde condensate.

8. The composition of claim 7, wherein the guanidine, dicyandiamide or cyanamide:formaldehyde molar ratio is in the range of 1:0.2 to 1:0.7.

9. The composition of claim 7, wherein the pH-value is greater than 5.0.

10. The composition of claim 9, wherein the guanidine, dicyandiamide or cyanamide:formaldehyde molar ratio is in the range of 0.2 to 0.7.

11. A process for flame-proofing textile materials, which comprises treating said materials with an emulsion in an organic water-insoluble solvent of the composition defined in claim 1.

12. A process in accordance with claim 11 wherein the textile contains cellulose or wool fibres.

13. A process in accordance with claim 11 wherein the finish is applied after the textile has been chemically cleaned.

14. A process in accordance with claim 11 wherein 7 to 15% by weight based on the weight of the air-dry fabric of the emulsified composition are applied to the textile.

15. A process in accordance with claim 11 wherein the finish is applied discontinuously by the dip-spinning method or by the spraying method.

16. A process in accordance with claim 11 wherein oil-proofing agents are applied to the textile simultaneously with the flame-proofing-finish.

17. Textile materials finished in accordance to claim 11.

* * * * *